US007769185B2

(12) United States Patent
Burns

(10) Patent No.: US 7,769,185 B2
(45) Date of Patent: Aug. 3, 2010

(54) SYSTEM FOR TESTING HEARING ASSISTANCE DEVICES USING A PLANAR WAVEGUIDE

(75) Inventor: Thomas Howard Burns, Chaska, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 1198 days.

(21) Appl. No.: 11/132,644

(22) Filed: May 19, 2005

(65) Prior Publication Data

US 2006/0262950 A1 Nov. 23, 2006

(51) Int. Cl.
*H04R 25/00* (2006.01)

(52) U.S. Cl. ..... 381/60; 381/312

(58) Field of Classification Search ..... 381/23.1, 381/58, 60, 312; 181/198, 199
See application file for complete search history.

(56) References Cited

U.S. PATENT DOCUMENTS

| | | | |
|---|---|---|---|
| 3,923,119 | A | 12/1975 | Frye |
| 4,065,647 | A | 12/1977 | Frye et al. |
| 4,674,123 | A | 6/1987 | Michas et al. |
| 5,105,822 | A | 4/1992 | Stevens et al. |
| 5,821,471 | A | 10/1998 | McCuller |
| 6,048,320 | A | 4/2000 | Brainard, II |
| 2002/0082794 | A1 | 6/2002 | Kachler et al. |

FOREIGN PATENT DOCUMENTS

| | | | |
|---|---|---|---|
| DE | 19623715 | * | 10/1997 |
| DE | 1962371501 | C1 | 10/1997 |
| EP | 0010169 | A1 | 4/1980 |

OTHER PUBLICATIONS

Titus, J., "I Can Hear You Now", *Test & Measurement World*, (Sep. 2003), 22-28.
"European Application Serial No. 06252617.3, Extended European Search report mailed Jul. 24, 2009", 8 pgs.

* cited by examiner

*Primary Examiner*—Brian Ensey
(74) *Attorney, Agent, or Firm*—Schwegman, Lundberg & Woessner, P.A.

(57) ABSTRACT

A system and method for testing and measuring hearing assistance devices using a plane wave tube is provided. According to an embodiment, a hearing assistance device is mounted proximal to an acoustic waveguide having a soundfield with acoustic waves propagating down the waveguide. A microphone of the hearing assistance device is placed in the soundfield of the acoustic waveguide to increase a direct acoustic component and to reduce reflected acoustic components and scattered acoustic components of sound sensed by the microphone. Sound is generated using a sound generator to propagate sound of desired frequencies down the waveguide.

28 Claims, 10 Drawing Sheets

SYSTEM FOR TESTING HEARING ASSISTANCE DEVICES USING A PLANAR WAVEGUIDE

FIELD OF THE INVENTION

The present subject matter relates generally to hearing assistance devices, and in particular to a method and apparatus for testing and measuring hearing assistance devices.

BACKGROUND

Hearing assistance devices, or hearing aids, are electronic instruments worn in or around the ear that compensate for hearing losses by amplifying sound. Because hearing loss in most patients occurs non-uniformly over the audio frequency range, hearing aids are usually designed to compensate for the hearing deficit by amplifying received sound in a frequency-specific manner. The clarity, noise reduction, and overall quality of the performance of these devices require that the frequency response of the devices be properly calibrated and tested during and after the production process. Testing of the electro-acoustic performance of hearing aids is important to verify that an instrument is functioning both according to the manufacturer's specifications and according to the auditory needs of the wearer.

Conventional testing of hearing assistance devices can be performed in a test box, which provides the acoustical environment, or the acoustical conditions under which the device under test (DUT) is measured. The total acoustical signal $P_t$ sensed by microphone(s) of the DUT typically consists of three components: a direct component $P_d$ from the loudspeaker, scattered components $P_s$ from reflections and diffraction off of the DUT and its fixtures and features, and the boundary reflections $P_r$ of the acoustical environment. Mathematically, $$P_t=P_d+P_s+P_r.$$

Therefore, the measured response of the DUT is dependent upon the relative magnitude and temporal contributions of the direct component, scattered components and reflected components from the test box boundaries. The scattered components and reflected components can inhibit the ability to properly test and calibrate the DUT. Thus, there is a need in the art for a method and apparatus for imparting sound to a hearing assistance device to reduce the occurrence of these indirect components and hence provide improved calibration and testing of hearing assistance devices.

SUMMARY

The present system provides a method and apparatus to address the foregoing needs and additional needs not stated herein. In one embodiment, the system provides a method and apparatus for testing and measuring a hearing assistance device. According to an embodiment, the hearing assistance device is mounted proximal to an acoustic waveguide having a soundfield with acoustic waves propagating down the waveguide. A microphone of the hearing assistance device is placed in the soundfield of the acoustic waveguide to increase a direct acoustic component and to reduce reflected acoustic components and scattered acoustic components of sound sensed by the microphone. Sound is generated using a sound generator to propagate sound of desired frequencies down the waveguide.

Another aspect of this disclosure relates to an apparatus for imparting sound to a hearing assistance device. According to one embodiment, the apparatus includes an acoustic waveguide having a soundfield with acoustic waves propagating down the waveguide. The apparatus also includes a mount fixedly receiving the hearing assistance device and adapted to place a microphone of the hearing assistance device in the soundfield of the acoustic waveguide, the mount adapted to place the microphone to increase a direct acoustic component and to reduce reflected acoustic components and scattered acoustic components of sound sensed by the microphone. The apparatus further includes a sound generator to propagate sound of desired frequencies down the waveguide. According to various embodiments, the apparatus is adapted to impart sound to a hearing assistance device having more than one microphone.

Other embodiments and aspects of embodiments are provided which are not summarized here. This Summary is an overview of some of the teachings of the present application and not intended to be an exclusive or exhaustive treatment of the present subject matter. Further details about the present subject matter are found in the detailed description and appended claims. Other aspects of the invention will be apparent to persons skilled in the art upon reading and understanding the following detailed description and viewing the drawings that form a part thereof, each of which are not to be taken in a limiting sense. The scope of the present invention is defined by the appended claims and their equivalents.

DETAILED DESCRIPTION

In the following detailed description, reference is made to the accompanying drawings which form a part hereof, and in which is shown by way of illustration specific embodiments in which the invention may be practiced. These embodiments are described in sufficient detail to enable those skilled in the art to practice the invention, and it is to be understood that the embodiments may be combined, or that other embodiments may be utilized and that structural, logical and electrical changes may be made without departing from the spirit and scope of the present invention. The following detailed description provides examples, and the scope of the present invention is defined by the appended claims and their equivalents.

It should be noted that references to "an", "one", or "various" embodiments in this disclosure are not necessarily to the same embodiment, and such references contemplate more than one embodiment.

Disclosed herein is a testing system and method for hearing assistance devices. The disclosed acoustic testing system provides a planar waveguide, or plane wave tube, in which planar acoustic waves propagate over the microphone inlets of a hearing assistance device. The system reduces reflected and scattered components of the acoustic wave, improving the reliability and accuracy of testing of hearing assistance devices. Further advantages of the system include: convenient and accurate placement of the hearing aids; repeatable measurement with negligible system error; excellent sound and vibration isolation; and improved efficiency of compensation. The system is adaptable for testing both in-the ear (ITE) and behind-the-ear (BTE) hearing assistance devices.

Figure 1:
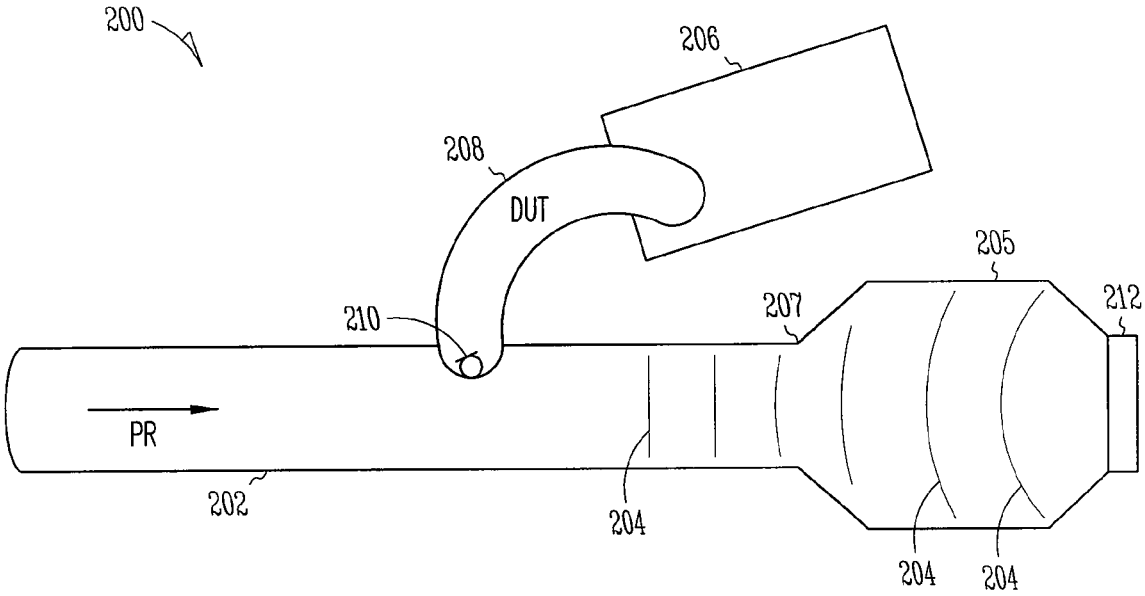
FIG. 1 is a diagram of a system for testing a hearing assistance device incorporating a planar waveguide, according to one embodiment of the present system.

FIG. 1 is a diagram of a system 200 for testing a hearing assistance device 208 incorporating a planar waveguide, according to one embodiment of the present system. An acoustic waveguide 202 is shown having a soundfield with acoustic waves 204 propagating down the waveguide 202. In this embodiment, a mount 206 for fixedly positioning the hearing assistance device 208 is adapted to place a microphone 210 of the hearing assistance device 208 in the soundfield of the acoustic waveguide. The mount 206 is adapted to place the microphone 210 to increase a direct acoustic component $P_d$ and to reduce reflected acoustic components $P_r$ and scattered acoustic components (not shown) of sound sensed by the microphone 210. A sound generator 212, or moving-coil loudspeaker, is used to propagate sound of desired frequencies down the waveguide 202. In this embodiment, loudspeaker 212 is a 1.5 inch diameter, closed-back woofer with ferrofluid damping. Other moving-coil, balanced-armature, or hybrid-type sound-generating devices could be substituted. Sound generator 212 is coupled to waveguide 202 through an air cavity 205. Air cavity 205 is shaped to appropriately couple the mechanical impedance of sound generator 212 to the acoustical impedance of waveguide 202. In this embodiment, the air cavity 205 is shaped like a tapered cylinder, though other shapes can be used depending on the properties of sound generator 212.

The boundary 207 of air cavity 205 and waveguide 202 defines a relative reference point for planar wavefronts to envelope within waveguide 202. Typically, for a waveguide having a circular cross-section, planar wavefronts develop approximately two waveguide diameters from boundary 207. Therefore, it is recommended to position microphone 210 at least approximately two waveguide diameters from boundary 207. If waveguide 202 has other cross-sectional shapes such as rectangular, or U-shaped, etc., the characteristic (largest) dimension should substitute as the defining criteria for planar wavefront development. It should also be noted that the internal cross section of the waveguide 202 may change subtly in the local region around device 208, thereby causing minimal perturbation in the developing planar wavefront.

The acoustic waveguide 202 provides a fixed relative distance between the microphone 210 of the device 208 and the loudspeaker 212, minimizes reflections from the boundaries of the test environment, and substantially eliminates the scattered component by positioning the microphone inlets within the test environment (waveguide) and positioning all other features and fixtures of the device outside the test environment. The waveguide 202 also provides an incident planar wavefront to the device at a known, repeatable angle and can provide simultaneously the same acoustical excitation (magnitude and phase) to multiple microphone ports on a device under test, when the ports are positioned along a line perpendicular to the axis of the waveguide.

In one embodiment of the system 200, the acoustic waveguide 202 has a circular cross section and cutoff frequency, i.e., the highest frequency for planely propagating acoustic waves, of 10 kHz. If the plane wave cutoff frequency is 10 kHz, the characteristic dimension, or diameter, of the waveguide is approximately 0.68 inches. For a plane wave cutoff frequency of 8 kHz, the characteristic dimension of the waveguide is approximately 0.85 inches. In another embodiment, the acoustic waveguide 202 provides an acoustic field with minimal reflections and a relatively flat frequency response between 100 Hz and 8 kHz. In various embodiments, the acoustic waveguide 202 provides an acoustic field from 100 Hz to 8 kHz with a relative level less than 15 dB in range, provides repeatable measurement of the hearing assistance device 208 with test-retest placement error less than 1 dB and dual microphone acoustic excitation disparity less than 0.1 dB, and provides between 20 dB (lowest frequencies) and 40 dB (mid to high frequencies) of sound isolation.

Figure 2:
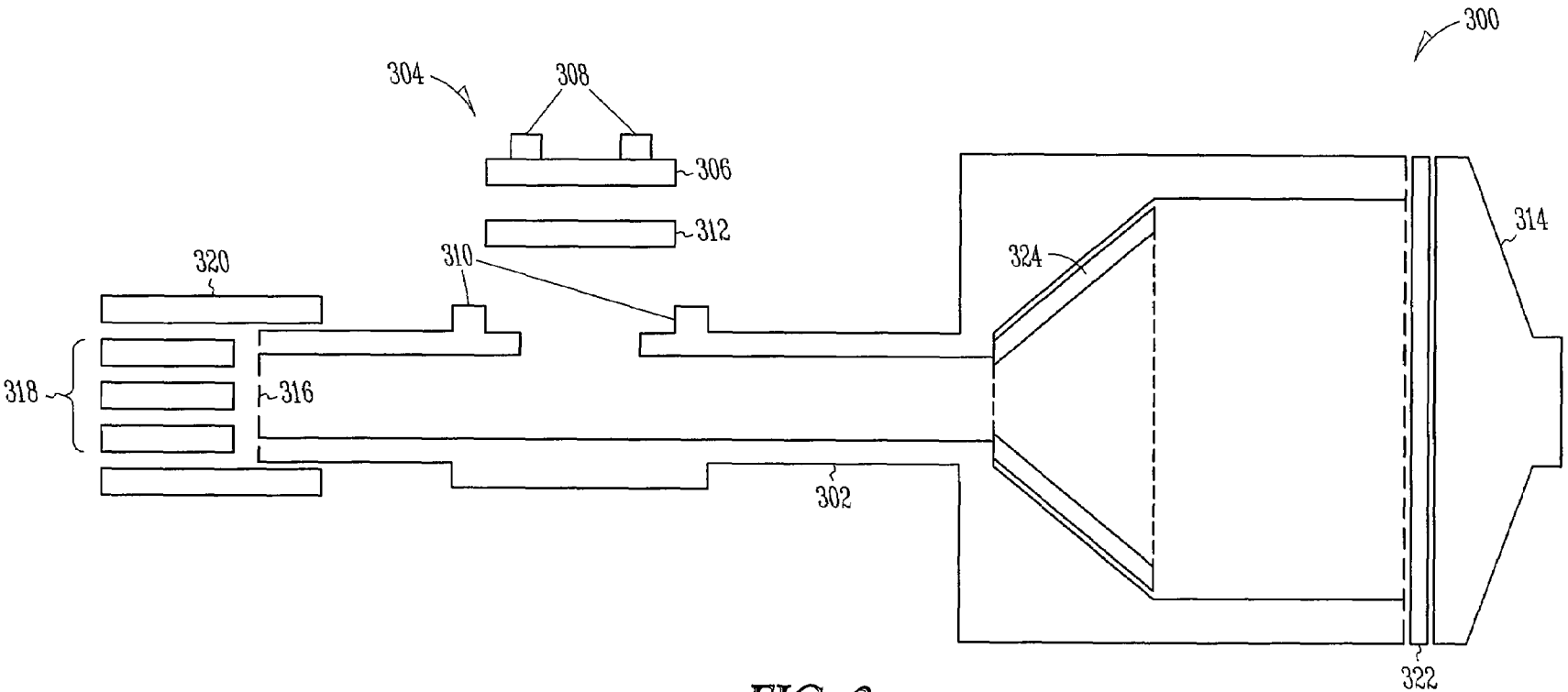
FIG. 2 is a diagram showing a cross-sectional side view of one embodiment of a system for imparting sound to a hearing assistance device, according to one embodiment of the present system.

FIG. 2 is a diagram showing a cross-sectional side view of one embodiment of a system 300 for imparting sound to a hearing assistance device, according to one embodiment of the present system. An acoustic waveguide 302, or plane wave tube, is shown having a soundfield with acoustic waves propagating down the waveguide. A mount 304 is provided for fixedly positioning the hearing assistance device. In this embodiment, the mount includes a holding fixture 306 with pins 308 for securing a faceplate 312 to the waveguide 302. According to this embodiment, magnets 310 along the surface of the waveguide are used to hold the fixture in place. One of ordinary skill will appreciate that other mounting methods are equally appropriate. Several others will be described in more detail below with respect to FIGS. 6A through 8C.

According to various embodiments, the mount 304 is further adapted to prevent portions of the hearing assistance device, other than the microphone of the hearing assistance device, from being placed in the soundfield of the acoustic waveguide 302.

In various embodiments of system 300, the acoustic waveguide 302 contains at least one minimally-reflecting boundary to dissipate acoustic waves. According to one embodiment, the acoustic waveguide 302 includes a damping structure 318 along the boundary 316 opposite the sound generator 314. The damping structure 318 may include a 0.25 inch thick layer of foam (100 ppi) or other acoustically absorptive material, which in an embodiment can be enclosed in a 20 foot long, 0.8 inch inner diameter, coiled, polyvinyl tube 320 stuffed loosely with fibrous, acoustically-absorptive material. Other sizes and types of tubes are within the scope of this disclosure. According to one embodiment, the acoustic waveguide 302 includes a boundary 316 opposite the sound generator 314 separated from the hearing assistance device by sufficient distance to dissipate boundary reflections.

A sound generator 314 or driver is used to propagate sound of desired frequencies down the waveguide. In one embodiment, the acoustic waveguide 302 includes an acoustic filter 322 adjacent the sound generator. The acoustic filter 322 may consist of a weaved fabric, metal etched screen, formed material of known acoustic resistance, or other acoustic filtering device. According to various embodiments, a damping filter 324 can be used at the cone section of the waveguide 302 to further improve acoustic filtering.

Figure 3:
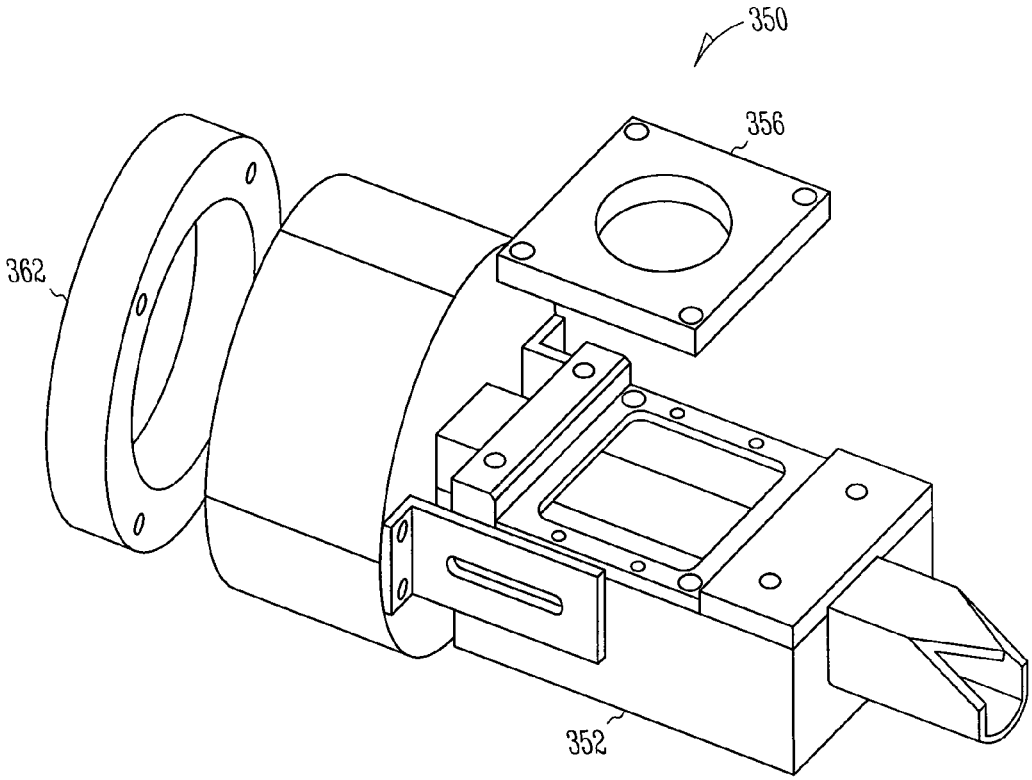
FIG. 3 is a diagram showing a three-dimensional view of one embodiment of a system for imparting sound to a hearing assistance device, according to one embodiment of the present system.

FIG. 3 is a diagram showing a three-dimensional view of one embodiment of a system 350 for imparting sound to a hearing assistance device, according to one embodiment of the present system. An acoustic waveguide 352 is shown having a cutoff frequency that is higher than any frequencies of interest, the waveguide 352 having a soundfield with acoustic waves propagating down the waveguide 352. In this embodiment, a mount 356 for fixedly receiving the hearing assistance device is adapted to place a first microphone and a second microphone of the hearing assistance device in the soundfield of the acoustic waveguide. The mount 356 is adapted to place the first microphone and the second microphone to increase a direct acoustic component $P_d$ and to reduce reflected acoustic components $P_r$ and substantially eliminate scattered acoustic components $P_s$ of sound sensed by the microphones. Those of skill in the art will recognize that more than two microphones (a third, a fourth, an Nth) may be placed in the soundfield using the disclosed system. A sound generator 362, or loudspeaker, is used to propagate sound of desired frequencies down the waveguide 352.

Figure 4:
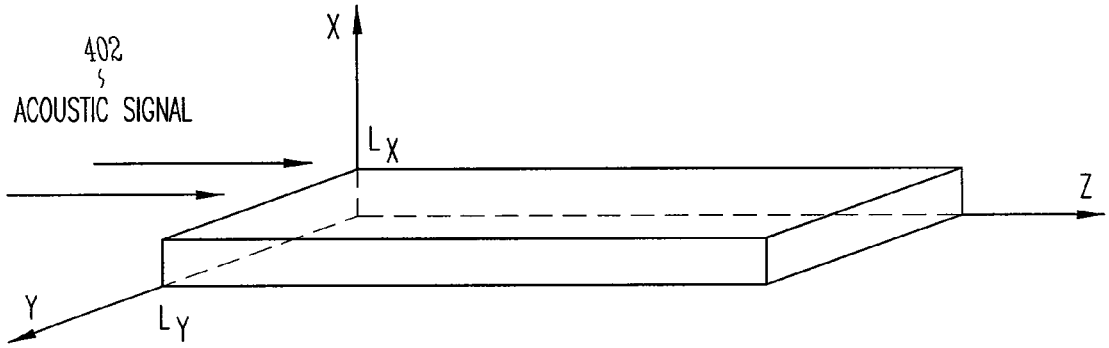
FIG. 4 is a diagram showing an acoustic field in a waveguide.

FIG. 4 is a diagram showing an acoustic field in a waveguide. The acoustic signal 402 is shown propagating in the Z-direction, and the dimensions of the waveguide ($L_x$ and $L_y$) are such that $L_{x,y}<\lambda/2$ where $\lambda$ is the signal's wavelength, i.e., the acoustic signal's frequency is $f<c/(2L_{x,y})$ where c is the sound speed. Under these conditions, planar pressure waves internal to the waveguide can be expressed mathematically as $$P(z)=[Ae^{jkz}-Be^{jkz}]e^{-j\omega t}.$$

where $j=-1^{1/2}$, $\omega=2\pi f$, and $k=\omega/c$. If the boundary at the end of the waveguide is sufficiently absorptive thereby rendering reflections in the Z-direction negligible, i.e., $B<<A$, then forward propagating waves dominate and the expression becomes $$P(z)=Ae^{j(kz-\omega t)}.$$

Under these conditions, the above expression indicates that both the pressure amplitude and phase are uniform over the waveguide's cross-section. Although the above expression suggests the pressure amplitude is constant along the Z-dimension, in practice there are small losses in the walls of the waveguide so that the planar wavefront is slightly attenuated as it propagates in the Z-direction away from the sound generator.

The general description above can be applied to waveguides having various cross-sectional areas. For example, instead of a waveguide with a rectangular cross-section of $L_x$ and $L_y$, an ameba-shaped cross section could be used. The principle of planar wave propagation can be extended here by considering the characteristic dimension, i.e., the largest dimension in the ameba's cross section and substituting it into the above equations for $L_{x,y}$.

Figure 5:
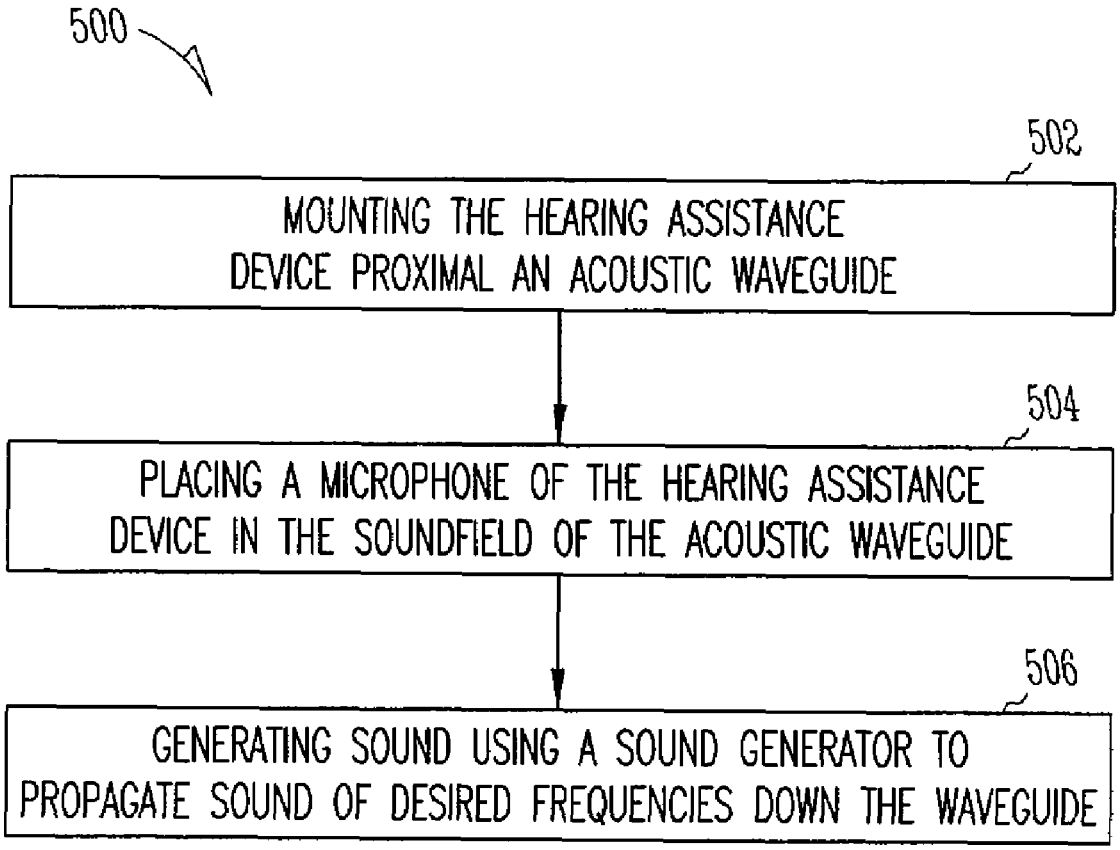
FIG. 5 is a flow diagram of a method for testing a hearing assistance device, according to one embodiment of the present system.

FIG. 5 is a flow diagram of a method for testing a hearing assistance device, according to one embodiment of the present system. According to this embodiment of the method 500, the hearing assistance device is mounted proximal to an acoustic waveguide having cutoff frequency that is higher than any frequencies of interest, the waveguide having a soundfield with acoustic waves propagating down the waveguide at 502. At 504, a microphone of the hearing assistance device is placed in the soundfield of the acoustic waveguide to increase a direct acoustic component and to reduce reflected acoustic components and scattered acoustic components of sound sensed by the microphone. At 506, sound is generated using a sound generator to propagate sound of desired frequencies down the waveguide. In one embodiment, a magnetic fixture is used to hold the hearing assistance device proximal an acoustic waveguide.

According to various embodiments, the method further includes measuring a frequency response of the hearing assistance device. According to various embodiments, the method further includes rotating the mount with respect to the waveguide to measure a polar response of the hearing assistance device, or to measure microphone mismatch of hearing assistance devices having multiple microphones. These data can further be used with pre-measured head related transfer functions in order to predict three-dimensional directional performance of the assistance device, thereby simulating measurements that would occur at the ears of the wearer.

Figure 6A:
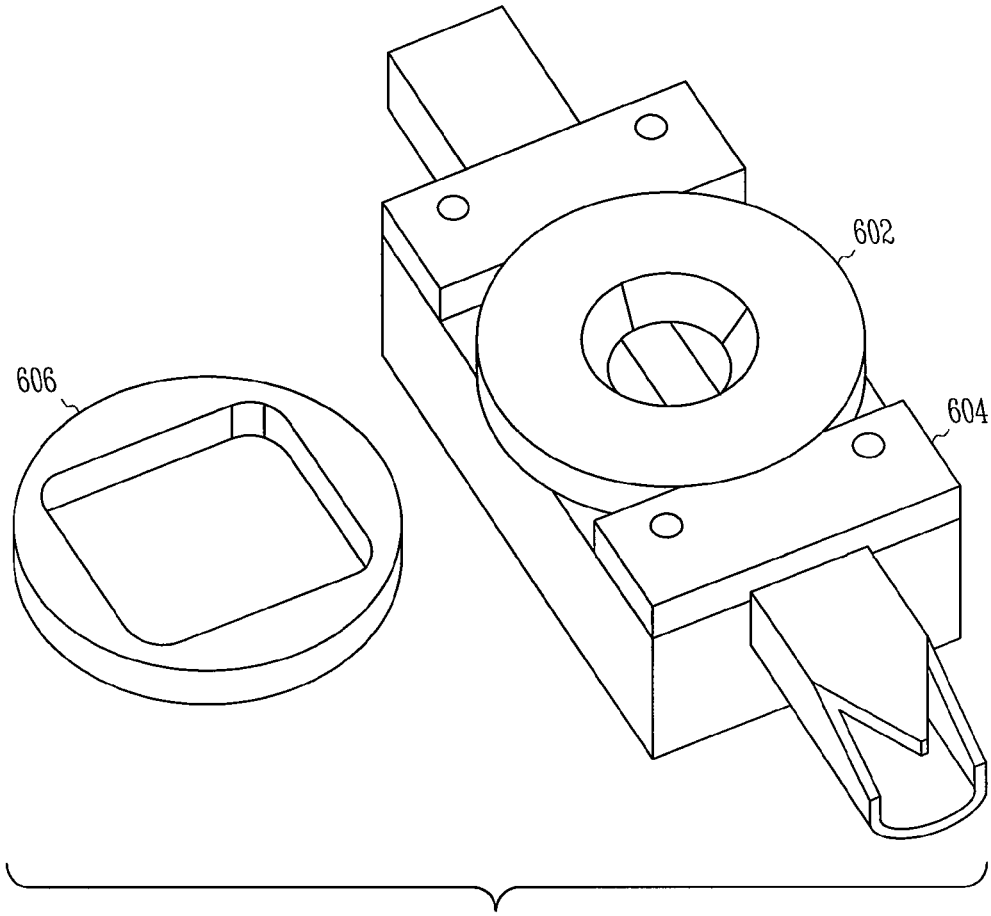
FIG. 6A is a diagram showing a rotational fixture for holding a hearing assistance device during testing, according to one embodiment of the present system.
Figure 6B:
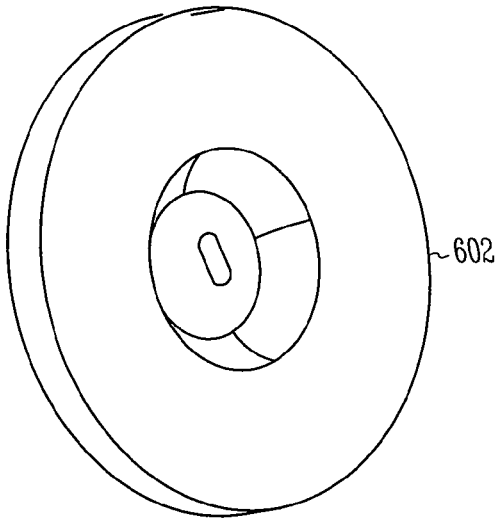
FIG. 6B is a close up view of a portion of FIG. 6A, according to one embodiment of the present system.

FIG. 6A is a diagram showing a rotational fixture 602 for holding a hearing assistance device during testing, according to one embodiment of the present system. The rotational fixture 602 allows for rotating the mount with respect to the waveguide 604 to measure polar response of the hearing assistance device. Circular member 606 integrates with rotational fixture 602 to mount the hearing assistance device for testing. FIG. 6B is a close up view of a portion of FIG. 6A, according to one embodiment of the present system. In this view, the rotational fixture 602 is shown apart from the waveguide.

Figure 7A:
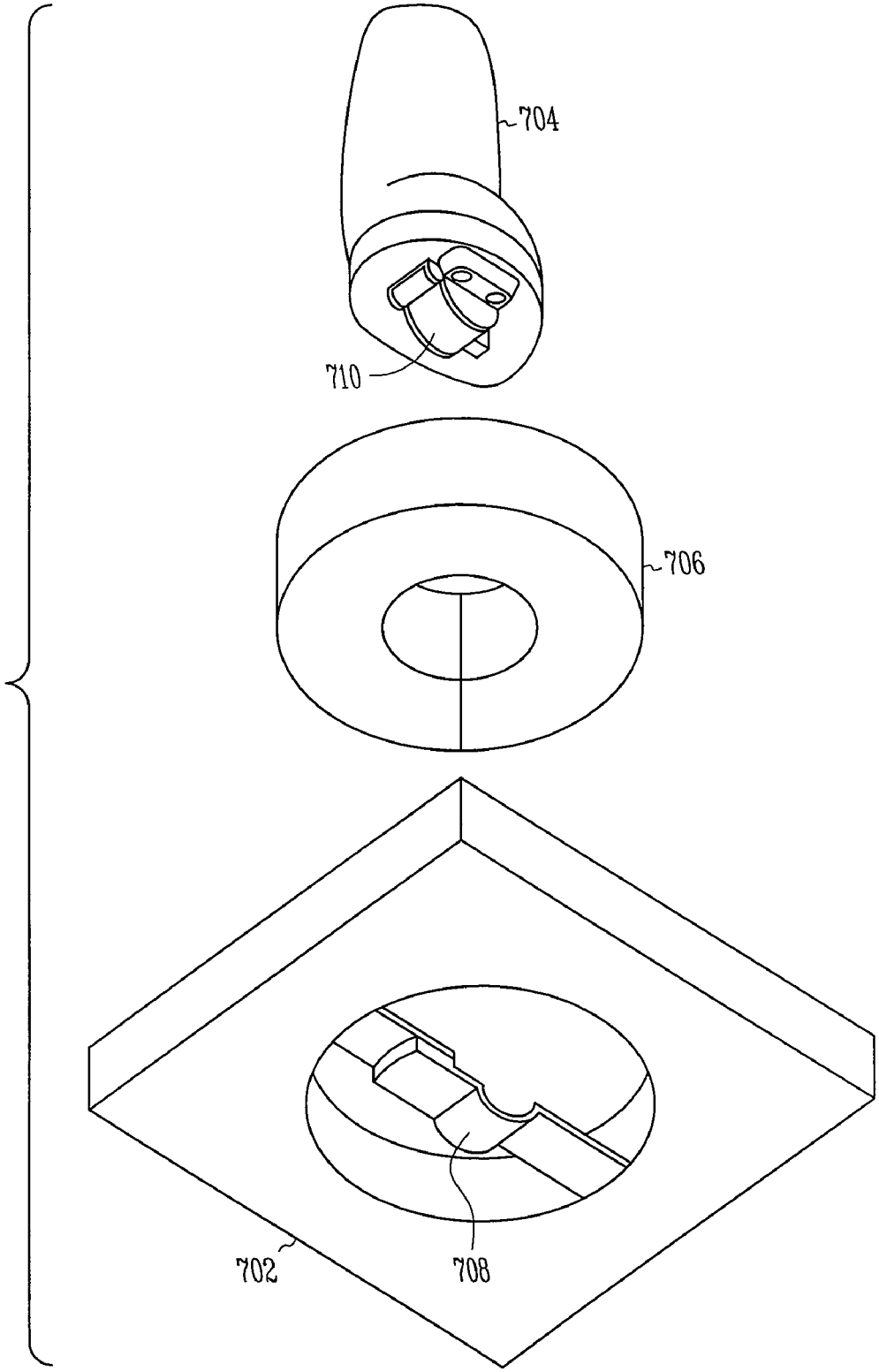
FIG. 7A is a diagram showing a battery-door-aligning fixture for holding a hearing assistance device during testing, according to one embodiment of the present system.

FIG. 7A is a diagram showing a battery-door-aligning fixture 702 for holding a hearing assistance device 704 during testing, according to one embodiment of the present system. The battery-door-aligning fixture 702 has a diametrical member 708 which is designed and fabricated to receive and align the battery door 710 of the hearing assistance device 704 under test. The battery-door-aligning fixture 702 may be constructed of metal, such as aluminum. According to this embodiment, a sealing gasket 706 provides an acoustic seal exposing only the microphone of the hearing assistance device to the waveguide during testing. The sealing gasket may be a preformed die-cut of closed cell foam, according to various embodiments.

Figure 7B:
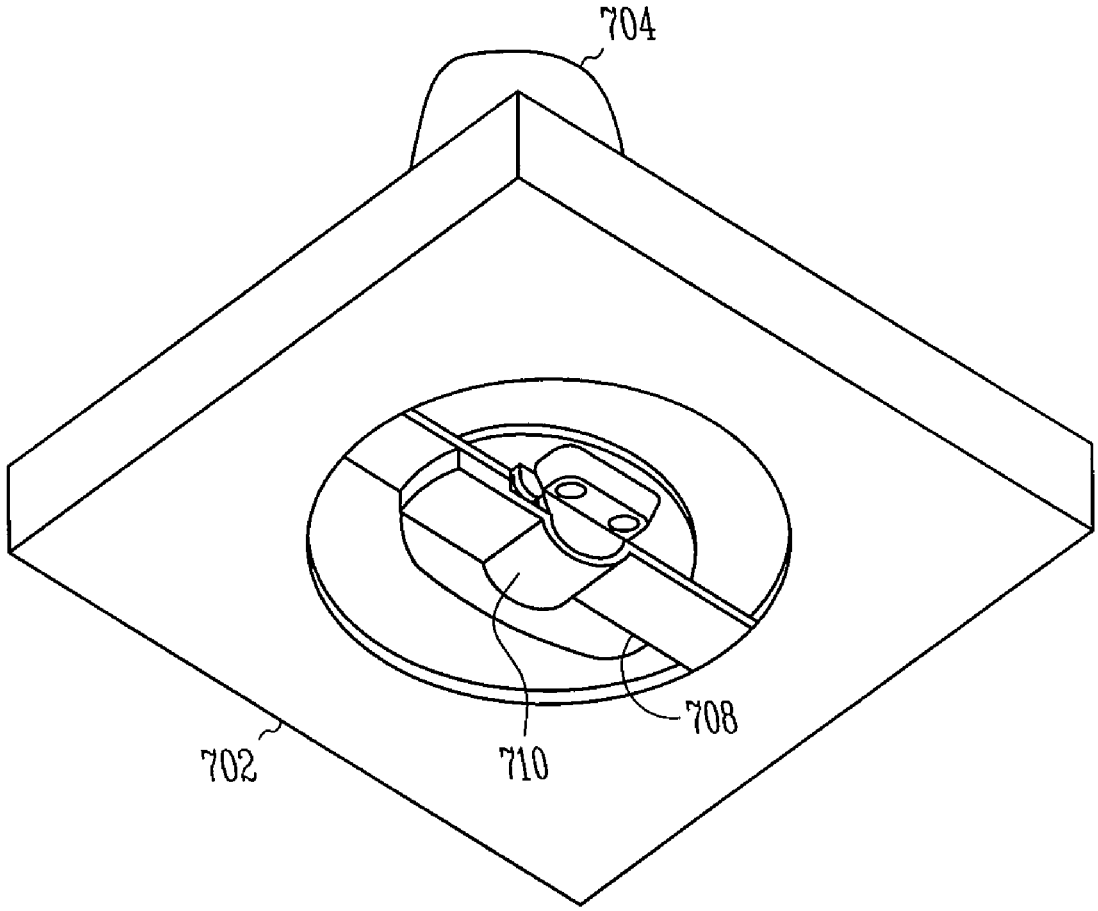
FIG. 7B is a diagram showing the assembled fixture of FIG. 7A, according to one embodiment of the present system.

FIG. 7B is a diagram showing the assembled fixture of FIG. 7A, according to one embodiment of the present system. The battery-door-aligning fixture 702 is shown affixed to the hearing assistance device 704. In this embodiment, the diametrical member 708 of the battery-door-aligning fixture 702 has oriented and located the battery door 710 of the hearing assistance device 704 under test. One of ordinary skill will appreciate that the described fixture can be designed and fabricated to accommodate all possible faceplates and battery-door configurations. In addition, the described mounting fixtures are adaptable for cased hearing aids.

Figure 8A:
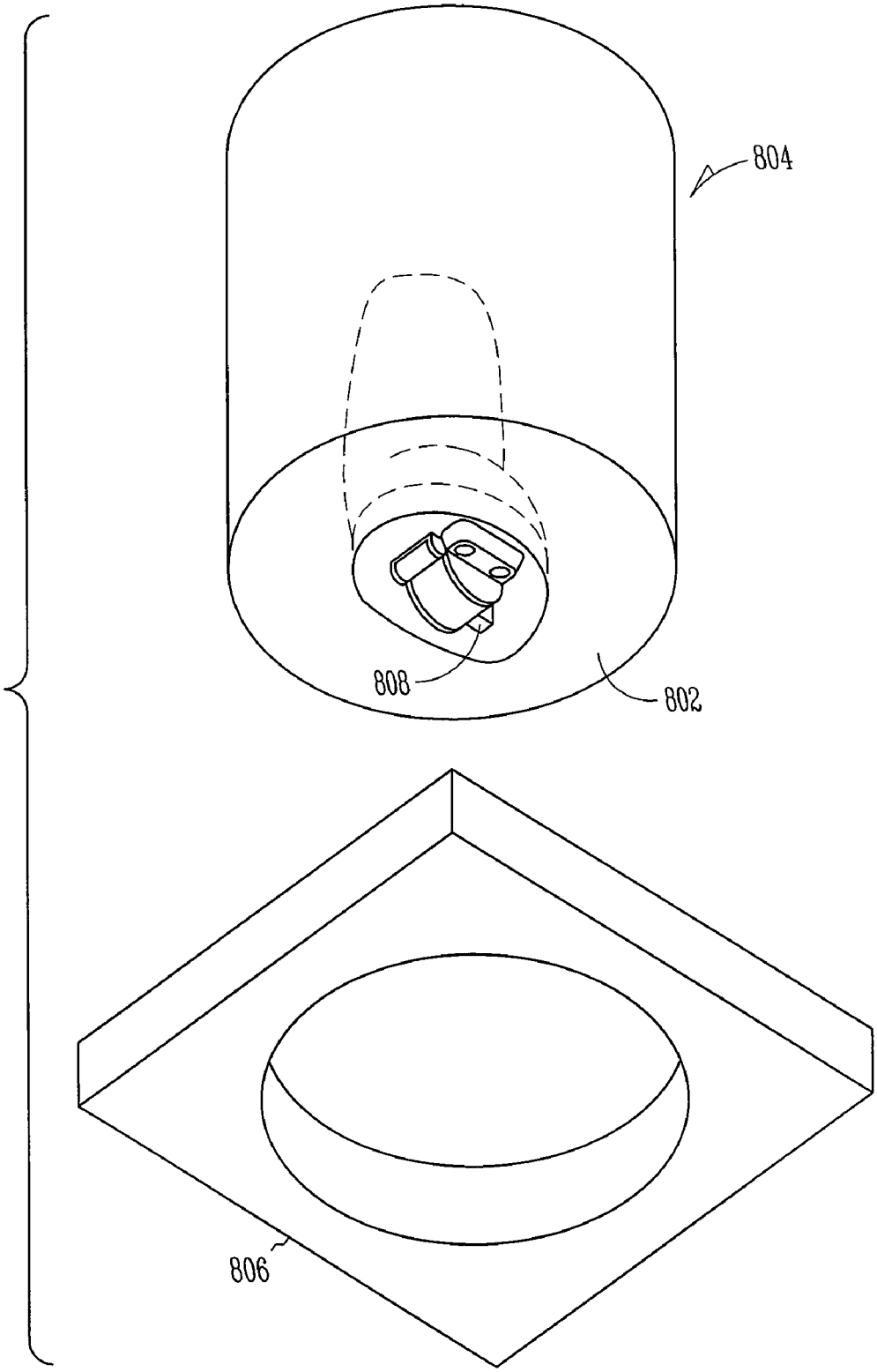
FIG. 8A is a diagram showing a silicone investment fixture for holding a hearing assistance device during testing, according to one embodiment of the present system.

FIG. 8A is a diagram showing a silicone investment fixture for holding a hearing assistance device 804 during testing, according to one embodiment of the present system. The silicone investment, or putty 802, seals the microphone portion 808 of the device 804 to the metal fixture 806, which is subsequently placed into an opening of a planar waveguide. In one embodiment, the metal fixture 806 is constructed of aluminum, but those of skill in the art will appreciate that other materials may be used.

Figure 8B:
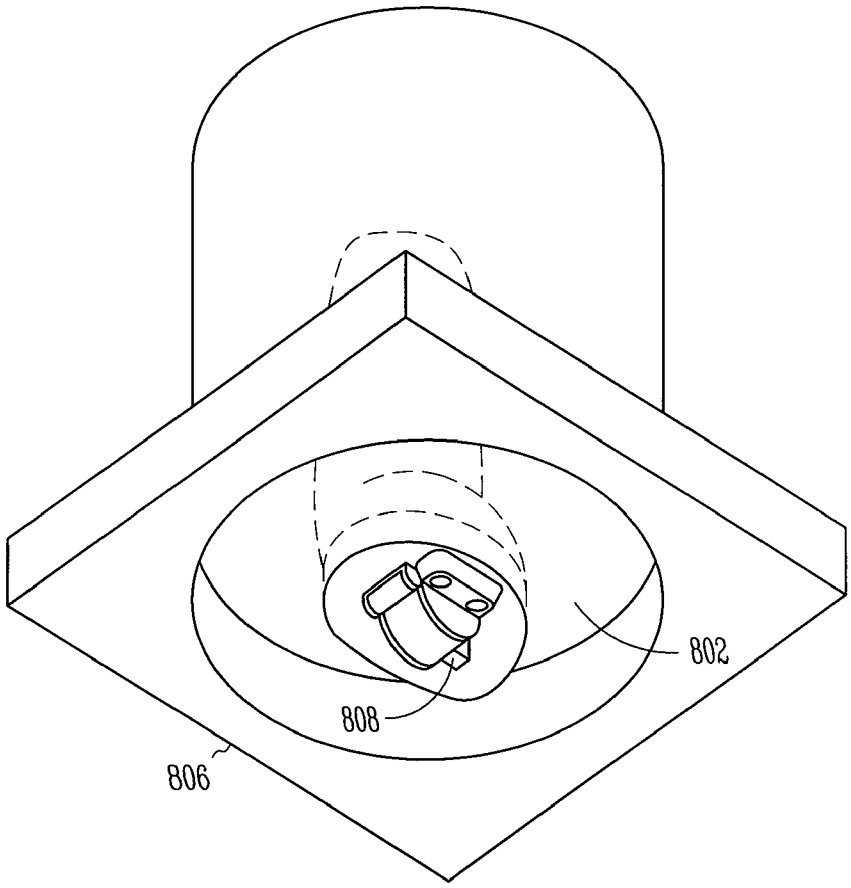
FIG. 8B is a diagram showing the assembled fixture of FIG. 8A, according to one embodiment of the present system.
Figure 8C:
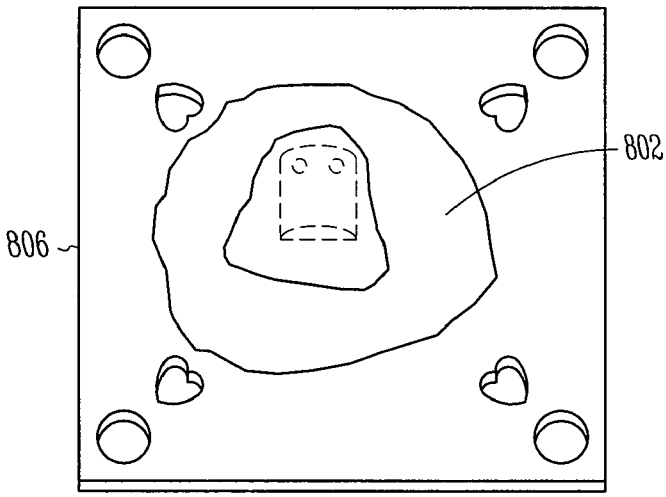
FIG. 8C is a diagram showing the silicone seal used in the fixture of FIG. 8A, according to one embodiment of the present system.

FIG. 8B is a diagram showing the assembled fixture of FIG. 8A, according to one embodiment of the present system. The silicone investment 802 has sealed the microphone portion 808 of the device to the metal fixture 806. In various embodiments, the silicone investment is a vacuum-forming investment. FIG. 8C is a diagram showing the use of putty, or fun-tack, in the fixture of FIG. 8A, according to one embodiment of the present system. The diagram depicts the underside of the metal fixture 806, showing the putty 802 sealing the device to the metal fixture 806.

Figure 9:
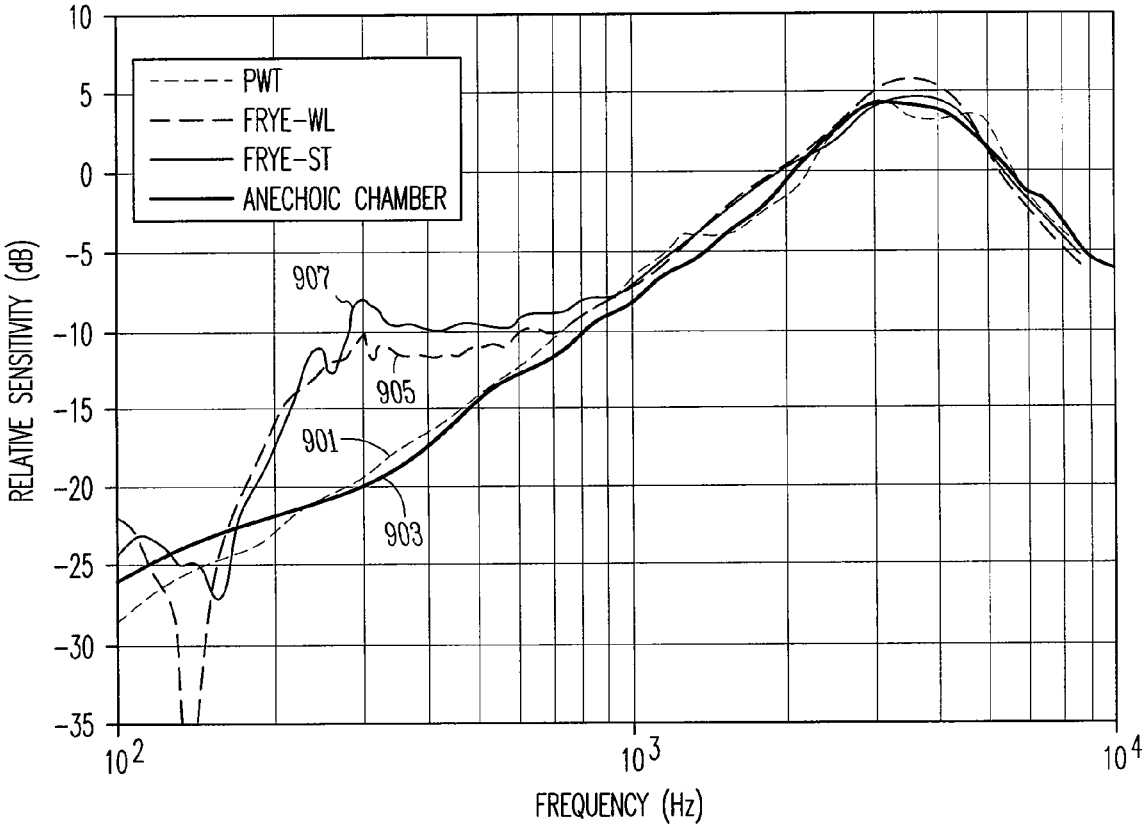
FIG. 9 is a graphic diagram showing a comparison of measurement sensitivity of conventional systems and one embodiment of the present system.

FIG. 9 is a graphic diagram showing a comparison of measurement sensitivity of conventional systems and one embodiment of the present system. The diagram, which plots relative sensitivity of measurement (in dB), reveals that a testing system environment provided by an embodiment of the present system 901 approaches the environment of an anechoic chamber 903, and is measurably different than two known environments, including a first Frye box 905 and a second Frye box 907.

The present system has a number of potential applications for testing sound amplification equipment. The following examples, while not exhaustive, are illustrative of these applications.

Delay-and-sum Directional Test

Using conventional testing environments for dual omni directional systems, a delay-and-sum directional hearing assistance device has its polar pattern adjusted by positioning the device such that a wavefront impinged on the device at an angle of approximately 120 degrees relative to the directional axis. The level of a potentiometer or value of resistance, controlling the relative level of the rear omni microphone, is then adjusted until the device's total output is minimized thereby prescribing a polar pattern that resembles a hypercardioid or supercardioid. This process is an indirect way of matching the amplitudes of the two omni microphones. Performance variance for this process was wide when done in a conventional test box, due primarily to box reflections that allow acoustic wavefronts to impinge on the device at angles other than 120 degrees.

Using the present system with a planar waveguide, the device is housed in a rotational fixture that allows the device to be rotated such that the incident wavefront impinges on the device at a precisely defined angle with negligible reflections from the boundaries of the test environment.

Directional Compensation of Channel Mismatch

In directional digital devices, the polar pattern was designed under the presumption that electro-mechanical-acoustical mismatch between the front and rear channels of the devices was perfectly characterized. This characterization was performed by subjecting the front and rear microphone inlets of the device to the same magnitude and phase of an acoustic field, and by using a least mean-square (LMS) signal processing scheme to compute a filter. When this filter was convolved with the output of the rear channel, the resultant response would match the response of the front channel so that the two channels were matched when the filter was engaged.

The problem with this approach in a conventional test box is that the acoustic excitation between the two microphone inlets, separated by very small distance (e.g., 5 mm), can cause substantial anomalies in directional processing. These anomalies are due to the LMS filter mischaracterizing acoustic mismatch as channel mismatch. The present system uses a planar waveguide to minimize acoustic excitation disparity between front and rear microphone inlets, thereby allowing more precise characterization of these directional digital devices.

On-axis Omni/Directional Response Equalization

In more contemporary directional digital devices, the signal processing switches dynamically in a non-adaptive manner between an omni pattern and a fixed directional patter. The algorithm that facilitates the switching is based on background noise processing. In these devices, it is preferred that the frequency response of directional mode is closely matched to the frequency response of omni mode, in order to allow unbiased estimates of background noise and more repeatable switching conditions.

Using a conventional test box, a frequency response of a directional device can vary substantially at each frequency depending on the angle of impingement of the acoustic wavefront used to test the device. This effect can prevent proper estimates of background noise using a dynamic-switching algorithm. The planar waveguide of the present system ensures a fixed relationship between the device and the impinging wavefronts, which provides a tighter frequency response measurement and thus better estimates for making dynamic switching decisions.

Post-production Polar Measurements

It is often desirable to perform polar measurements on individual devices at the end of production for quality control. Using the present testing system with a planar waveguide, a device can be mounted in a rotational fixture that can be rotated at specific rates and angles. The output polar response can be measured accurately and rapidly, and then provided to a user on a data sheet. In addition, these polar measurements can be used to predict KEMAR (Knowles Electronics Mannequin for Acoustic Measurements) polar patterns through additional modeling, eliminating the need for actual mannequin testing. Three dimensional KEMAR polar patterns can be provided to the user on a data sheet or displayed on a website using a user-specific password or identification number.

Although the present system is discussed in terms of hearing aids, it is understood that many other applications in other hearing devices and audio devices are possible. It is to be understood that the above description is intended to be illustrative, and not restrictive. Other embodiments will be apparent to those of skill in the art upon reviewing and understanding the above description. The scope of the invention should, therefore, be determined with reference to the appended claims, along with the full scope of equivalents to which such claims are entitled.

What is claimed is:

1. A method for testing a hearing assistance device, the method comprising the acts of:

mounting the hearing assistance device proximal to an acoustic waveguide having a soundfield with acoustic waves propagating down the waveguide;

placing a microphone of the hearing assistance device in the soundfield of the acoustic waveguide to increase a direct acoustic component and to reduce reflected acoustic components and scattered acoustic components of sound sensed by the microphone; and generating sound using a sound generator to propagate sound of desired frequencies down the waveguide.

2. The method of claim 1 wherein mounting the hearing assistance device proximal to an acoustic waveguide includes mounting the hearing assistance device proximal to an acoustic waveguide having a cutoff frequency of 10 kHz.

3. The method of claim 1 further comprising the act of:

measuring frequency response of the hearing assistance device.

4. The method of claim 1 further comprising the act of:

rotating the hearing assistance device with respect to the waveguide to measure polar response of the hearing assistance device.

5. The method of claim 4 further comprising the act of:

utilizing the measured polar response of the hearing assistance device to predict KEMAR polar patterns.

6. The method of claim 1 wherein mounting the hearing assistance device proximal to an acoustic waveguide includes using a rotational fixture to hold the hearing assistance device in place.

7. The method of claim 1 wherein mounting the hearing assistance device proximal to an acoustic waveguide includes using a magnetic fixture to hold the hearing assistance device in place.

8. The method of claim 1 wherein mounting the hearing assistance device proximal to an acoustic waveguide includes using a battery door of the hearing assistance device to hold the hearing assistance device in place.

9. The method of claim 1 wherein mounting the hearing assistance device proximal to an acoustic waveguide includes a gasket to seal the hearing assistance device in the waveguide.

10. The method of claim 1 wherein mounting the hearing assistance device proximal to an acoustic waveguide includes using a silicone investment to hold the hearing assistance device in place and to seal the hearing assistance device in the waveguide.

11. An apparatus for imparting sound to a hearing assistance device, comprising:

an acoustic waveguide having a soundfield with acoustic waves propagating down the waveguide;

a mount fixedly positioning the hearing assistance device to place a microphone of the hearing assistance device in the soundfield of the acoustic waveguide, to increase a direct acoustic component, and to reduce reflected acoustic components and scattered acoustic components of sound sensed by the microphone; and a sound generator to propagate sound of desired frequencies down the waveguide.

12. The apparatus of claim 11 wherein the acoustic waveguide has a cutoff frequency of 10 kHz.

13. The apparatus of claim 11 wherein the acoustic waveguide provides a uniform planar sound wave below 10 kHz.

14. The apparatus of claim 11 wherein the acoustic waveguide provides a flat acoustic field with minimal reflections between 100 Hz and 8 kHz.

15. The apparatus of claim 14 wherein the acoustic waveguide provides an acoustic field less than 15 dB in range.

16. The apparatus of claim 11 wherein the acoustic waveguide provides repeatable measurement of the hearing assistance device with test-retest placement error less than 1 dB and dual microphone acoustic excitation disparity less than 0.1 dB, and provides between 20 dB (lowest frequencies) and 40 dB (mid to high frequencies) of sound isolation.

17. The apparatus of claim 11 wherein the acoustic waveguide provides sound isolation with a signal to noise ratio better than 40 dB.

18. The apparatus of claim 11 wherein the acoustic waveguide contains at least one minimally-reflecting boundary to dissipate acoustic waves.

19. The apparatus of claim 11 wherein the acoustic waveguide includes a boundary opposite the sound generator separated from the hearing assistance device by sufficient distance to dissipate boundary reflections.

20. The apparatus of claim 19 wherein the acoustic waveguide includes a damping structure along the boundary opposite the sound generator.

21. The apparatus of claim 20 wherein the damping structure includes a 0.25 inch thick piece of foam embedded at the boundary of the waveguide.

22. The apparatus of claim 11 wherein the acoustic waveguide includes an acoustic filter adjacent to the sound generator.

23. The apparatus of claim 22 wherein the acoustic filter includes a weaved fabric filter.

24. The apparatus of claim 11 wherein the mount is further adapted to prevent portions of the hearing assistance device, other than the microphone of the hearing assistance device, from being placed in the soundfield of the acoustic waveguide.

25. An apparatus for imparting sound to a hearing assistance device, comprising:

an acoustic waveguide having a soundfield with acoustic waves propagating down the waveguide;

a mount fixedly positioning the hearing assistance device, the mount placing a first microphone and a second microphone of the hearing assistance device in the soundfield of the acoustic waveguide, the mount placing the first microphone and the second microphone to increase a direct acoustic component and to reduce reflected acoustic components and scattered acoustic components of sound sensed by the first microphone and the second microphone; and a sound generator to propagate sound of desired frequencies down the waveguide.

26. The apparatus of claim 25 wherein the mount is adapted to place a third microphone of the hearing assistance device in the soundfield of the acoustic waveguide.

27. The apparatus of claim 26 wherein the mount is adapted to place a fourth microphone of the hearing assistance device in the soundfield of the acoustic waveguide.

28. The apparatus of claim 27 wherein the mount is adapted to place an Nth microphone of the hearing assistance device in the soundfield of the acoustic waveguide.

* * * * *